US010378369B2

(12) United States Patent
Yokoyama et al.

(10) Patent No.: US 10,378,369 B2
(45) Date of Patent: Aug. 13, 2019

(54) TURBINE

(71) Applicants: MITSUBISHI HEAVY INDUSTRIES, LTD., Tokyo (JP); IMPERIAL INNOVATIONS LTD, London (GB)

(72) Inventors: Takao Yokoyama, Tokyo (JP); Seiichi Ibaraki, Tokyo (JP); Ricardo Martinez-Botas, London (GB); Mingyang Yang, London (GB)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 355 days.

(21) Appl. No.: 15/107,657

(22) PCT Filed: Jan. 5, 2015

(86) PCT No.: PCT/JP2015/050050
§ 371 (c)(1),
(2) Date: Jun. 23, 2016

(87) PCT Pub. No.: WO2015/099199
PCT Pub. Date: Jul. 2, 2015

(65) Prior Publication Data

US 2016/0319683 A1 Nov. 3, 2016

(30) Foreign Application Priority Data

Dec. 27, 2013 (JP) ..... 2013-271673

(51) Int. Cl.
*F01D 9/02* (2006.01)
*F01D 5/04* (2006.01)
*F01D 25/24* (2006.01)

(52) U.S. Cl.
CPC ..... *F01D 9/026* (2013.01); *F01D 5/043* (2013.01); *F01D 25/24* (2013.01);
(Continued)

(58) Field of Classification Search
CPC ..... F04D 29/40; F04D 29/403; F04D 29/42; F04D 29/4206; F04D 29/4213;
(Continued)

(56) References Cited

U.S. PATENT DOCUMENTS 8,226,358 B2 7/2012 Matsuo et al.
2009/0007564 A1 1/2009 Suzuki et al.
(Continued)

FOREIGN PATENT DOCUMENTS

CN 101982647 A 3/2011
CN 103038479 A 4/2013
(Continued)

OTHER PUBLICATIONS

Office Action effective Feb. 12, 2018 issued to the corresponding Chinese Application No. 201580003295.0.
(Continued)

*Primary Examiner* — Carlos A Rivera
*Assistant Examiner* — Danielle M. Christensen
(74) *Attorney, Agent, or Firm* — Birch, Stewart, Kolasch & Birch, LLP

(57) ABSTRACT

A turbine is provided with a turbine rotor blade, and a turbine housing having a scroll part extending along a circumferential direction of the turbine rotor blade. The scroll part is configured such that an A/R ratio of a flow passage area A to a distance R between an axis of the turbine rotor blade and a flow passage center of the scroll part has a concave distribution at least in a part of a graph where an abscissa represents a circumferential position around the axis of the turbine rotor blade and an ordinate represents the A/R ratio.

4 Claims, 5 Drawing Sheets

(52) U.S. Cl.
CPC ..... *F05D 2220/40* (2013.01); *F05D 2240/14* (2013.01); *F05D 2240/24* (2013.01)

(58) Field of Classification Search
CPC ..... F04D 29/4293; F01D 5/043; F01D 9/026; F01D 25/24; F05D 2240/14; F05D 2220/40
See application file for complete search history.

(56) References Cited

U.S. PATENT DOCUMENTS

| | | | |
|---|---|---|---|
| 2009/0220335 | A1 | 9/2009 | Matsuo et al. |
| 2010/0074744 | A1 | 3/2010 | Phillips, Jr. et al. |
| 2013/0052054 | A1 | 2/2013 | Loringer et al. |
| 2013/0121820 | A1 | 5/2013 | Yoshida et al. |
| 2013/0219885 | A1 | 8/2013 | Watson et al. |
| 2013/0266433 | A1 | 10/2013 | Yokoyama et al. |

FOREIGN PATENT DOCUMENTS

| | | | |
|---|---|---|---|
| CN | 103261622 | A | 8/2013 |
| EP | 2 617 961 | A1 | 7/2013 |
| JP | 63-186915 | A | 8/1988 |
| JP | 10-8977 | A | 1/1998 |
| JP | 2003-120303 | A | 4/2003 |
| JP | 3534728 | B2 | 6/2004 |
| JP | 4512617 | B2 | 7/2010 |
| JP | 2011-231780 | A | 11/2011 |
| JP | 4875644 | B2 | 2/2012 |
| JP | 2012-97699 | A | 5/2012 |
| JP | 5087160 | B2 | 11/2012 |
| WO | WO 2012/061545 | A2 | 5/2012 |

OTHER PUBLICATIONS

International Preliminary Report on Patentability and Written Opinion of the International Searching Authority (forms PCT/IB/373, PCT/ISA/237, PCT/IB/326 and PCT/IB/338), dated Jul. 7, 2016, for International Application No. PCT/JP2015/050050, along with English translations.

International Search Report (forms PCT/ISA/210 and PCT/ISA/220), dated Mar. 17, 2015, for International Application No. PCT/JP2015/050050.

Japanese Notice of Allowance, dated Dec. 25, 2015, for Japanese Application No. 2013-271673, along with an English translation.

Japanese Office Action, dated Mar. 6, 2015, for Japanese Application No. 2013-271673, along with an English translation.

Extended European Search Report effective Dec. 20, 2016 issued in the corresponding EP Application No. 15731236.4.

Office Action effective Jun. 29, 2017 issued to the corresponding Korean Application No. 10-2016-7016885 with an English Translation.

TURBINE

TECHNICAL FIELD

The present invention relates to a turbine.

BACKGROUND ART

A housing for a turbine used in a turbocharger and the like has a scroll part. This scroll part extends along the circumferential direction of a turbine rotor blade to surround the turbine rotor blade. The scroll part is configured so that fluid flowing into an inlet of the scroll part impinges on the turbine rotor uniformly over the entire circumference of the turbine blade. Specifically, the scroll part is configured such that a A/R ratio of a flow passage area A of the scroll part to a distance R between an axis of the turbine rotor blade and a flow passage center of the scroll part decreases from the inlet of the scroll part toward an end of the scroll part.

For instance, FIG. 4 of Patent Reference 1 illustrates curves representing respective relationships between a position of a passage of the scroll part in the circumferential direction of the turbine rotor and the A/R ratio. These curves have upward convex shapes, and a change rate of A/R increases on a terminal side of the scroll part.

Further, there are some cases where A/R linearly decreases from a turbine inlet to a turbine exducer.

CITATION LIST

Patent Reference

Patent Document 1: US 2013/0219885

SUMMARY

Problem to be Solved

Conventionally, a scroll part of a turbine has been designed without considering exhaust pulsation. This is because it is thought the effect of the exhaust pulsation can be ignored as the cycle of the exhaust pulsation is long and also it is difficult to design the turbine with the exhaust pulsation in mind as it requires evaluation of an unsteady flow in the turbine.

However, it has been reported in recent years that the exhaust pulsation deteriorates turbine efficiency. In view of the report, the performance decline is caused by the exhaust pulsation in existing turbines as well.

In such situation, by designing the scroll part of the turbine based on a new concept which considers the exhaust pulsation, it is possible to not only improve the turbine efficiency but improve fuel efficiency in an automobile, a ship or the like in which the turbine is used.

In view of this, it is an object of at least one embodiment of the present invention to provide a turbine which has favorable turbine efficiency even when introduced fluid contains pulsation

Solution to the Problems

A turbine according to at least one embodiment of the present invention comprises:

a turbine rotor blade;

a turbine housing having a scroll part extending along a circumferential direction of the turbine rotor blade, and the scroll part is configured such that an A/R ratio of a flow passage area A to a distance R between an axis of the turbine rotor blade and a flow passage center of the scroll part has a concave distribution at least in a part of a graph where an abscissa represents a circumferential position around the axis of the turbine rotor blade and an ordinate represents the A/R ratio.

With this configuration, the A/R ratio has a concave distribution at least in a part of the graph, and the flow passage area of the scroll part changes more significantly on the inlet side than on the end side. Therefore, the volume of the scroll part is reduced significantly on the inlet side compared to the conventional case.

With the reduced volume of the scroll part on the inlet side, the amplitude of the pulsation pressure of the fluid is increased on the inlet side of the scroll part. Further, with the increased pulsation pressure on the inlet side, the fluid flows smoothly toward the turbine rotor blade on the inlet side of the scroll part. As a result, the turbine efficiency is improved, hence improving the turbine output.

In the conventional case where the A/R decreases linearly, it is necessary to reduce the inlet area of the scroll part to reduce the volume of the scroll part. However, by reducing the inlet area of the scroll part, the flow characteristic changes significantly. In this view, with the above configuration, the volume is reduced on the inlet side of the scroll part and thus, it is possible to reduce the volume of the scroll part without changing the inlet area of the scroll part. As a result, with this configuration, it is possible to minimize the effects on the flow characteristic and improve the turbine efficiency.

In some embodiments, provided that the circumferential position is 0° at an inlet of the scroll part and a positional value of the circumferential position increases from the inlet toward an end of the scroll part, the scroll part is configured such that a rate of change of the A/R while the circumferential position changes from 0° to 90° is at least 1.2 times higher than a case where the A/R linearly decreases.

With this configuration, as the rate of change of the A/R is at least 1.2 times higher than the case where the A/R linearly decreases, if the flow passage area at the inlet of the scroll part is maintained at the same value as the linear reduction case, the volume of the scroll part can be reduced. As a result, even if there is pulsation, it is possible to reliably improve the turbine efficiency while minimizing the effect on the flow characteristic.

In some embodiments, as the rate of change of the A/R is at least 1.4 times higher than the case where the A/R linearly decreases, if the flow passage area at the inlet of the scroll part is maintained at the same value as the case where the A/R linearly decreases, the volume of the scroll part can be further reduced compared to the case where the A/R linearly decreases. As a result, it is possible to further improve the turbine efficiency while minimizing the effect on the flow characteristic.

In some embodiments, the scroll part is configured such that the rate of change of the A/R while the circumferential position changes from 0° to 90° is up to three times higher than a case where the A/R linearly decreases.

As the rate of change of the A/R while the circumferential position θ changes from 0° to 90° is up to three times higher than the linear reduction case, it is possible to prevent local excessive increase of an angle of the flow formed by the scroll part, hence suppressing generation of the pressure loss.

Advantageous Effects

According to at least one embodiment of the present invention, it is possible to provide a turbine which has favorable turbine efficiency even if fluid to be introduced contains pulsation.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

Figure 1:
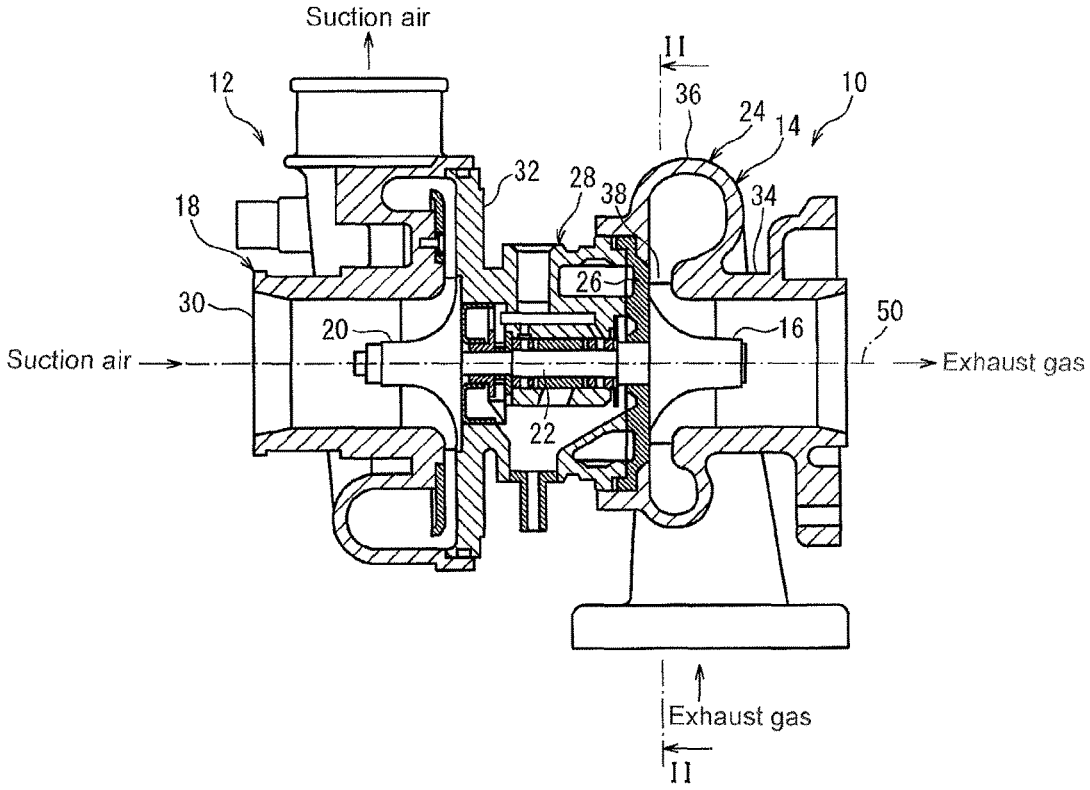
FIG. 1 is a schematic cross-sectional view of a turbocharger along a longitudinal direction, according to some embodiments of the present invention.

FIG. 1 is a schematic cross-sectional view of a turbocharger taken along a longitudinal direction, according to some embodiments of the present invention. The turbocharger is applicable to a vehicle, a ship, etc.

The turbocharger comprises provided with a turbine 10 and a compressor 12. The turbine 10 comprises a turbine housing 14, and a turbine rotor blade (an impeller) 16 accommodated in the turbine housing 14. The compressor 12 comprises a compressor housing 18 and an impeller accommodated in the compressor housing 18.

The turbine rotor blade 16 of the turbine 10 and the impeller 20 of the compressor 12 are coupled to each other via a shaft 22. The turbine rotor blade 16 of the turbine 10 is rotated with exhaust gas exhausted from an internal combustion engine. By this, the impeller 20 of the compressor 12 is rotated via the shaft 22. Then, by the rotation of the impeller 20 of the compressor 12, suction air supplied to the internal combustion engine is compressed.

For instance, the turbine housing 14 is configured by a turbine casing 24 and an end wall 26 which is connected to the turbine casing 24, and the shaft 22 passes through the end wall 26. The end wall 26 is sandwiched between the turbine casing 24 and the bearing housing 28, and the bearing housing 28 is configured to rotatably support the shaft 22 via a bearing.

For instance, the compressor housing 18 is configured by a compressor casing 30 and an end wall 32 which is connected to the compressor casing 30, and the shaft 22 passes through the end wall 32. The end wall 32 is integrally formed with the bearing housing 28.

The turbine housing 14 comprises a tubular part 34 accommodating the turbine rotor blade 16, a scroll part (a volute part) extending along the circumferential direction of the turbine rotor blade 16 and the tubular part 34, and a communication part 38 which brings the tubular part 34 and the scroll part 36 into communication with each other. In some embodiments, the turbine housing 14 comprises an introducing part 40 for fluid, which continues to the scroll part 36. An outlet for fluid is formed by the tubular part 34.

Figure 2:
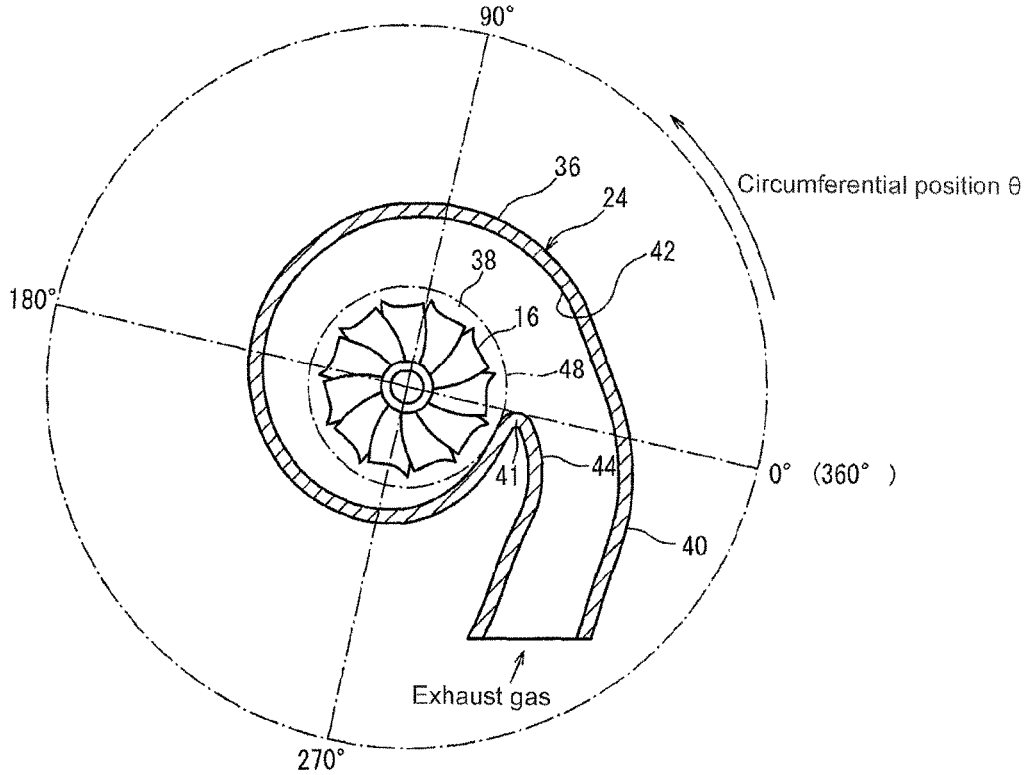
FIG. 2 is a schematic cross-sectional view along line II-II of FIG. 1.

FIG. 2 is a schematic cross-sectional view along line II-II of FIG. 1.

The circumferential position of the turbine rotor blade 16 (the circumferential position θ) is 0° at an inlet (a starting end) of the scroll part 36, as illustrated in FIG. 2. The position where the circumferential position θ is 0° is defined as a tip of a tongue part 41. The tongue part 41 is a section where an outer peripheral wall 42 of the scroll part 36 of the turbine casing 24 intersects a wall 44 of the introducing part 40 at an acute angle.

The circumferential position of the turbine rotor blade 16 (the circumferential position θ) is 360° at an end of the scroll part 36.

Further, it is provided that a positional value of the circumferential position θ increases from the inlet toward the end of the scroll part 36 in a flow direction of the fluid in the scroll part 36.

Meanwhile, an inner peripheral edge of the scroll part 36 is defined by a virtual circle 48 around an axis (a rotation axis) of the turbine rotor blade 16 such as to contact the tongue part 41.

An outer peripheral edge of the scroll part 36 is defined by the outer peripheral wall 42 of the scroll part 36, and a flow passage area A of the scroll part 36 is an area of a space which is formed between the circle 48 and the outer peripheral wall 42 of the scroll part 36.

Figure 3:
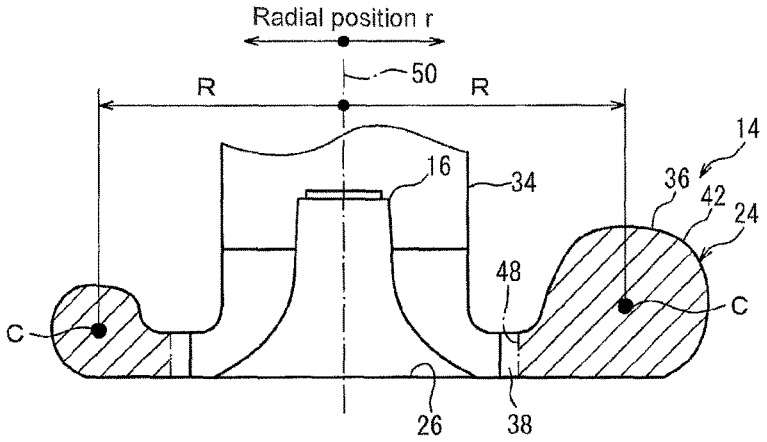
FIG. 3 is an explanatory diagram of A/R of a scroll part.

FIG. 3 is an explanatory diagram of A/R of the scroll part 36. The A/R is a ratio of the flow passage area A of the scroll part 36 to a distance R between the axis 50 of the turbine rotor blade 16 and the flow passage center C of the scroll part 36. In FIG. 3, the sections with the hatches represent a flow passage of the scroll part 36.

Here, the A/R is defined by the following formula (1).

$$A/R = \int_A \frac{1}{r} dA \tag{1}$$

where r is a radial position in the radial direction of the turbine rotor blade 16, and dA is a small area element of the section of the flow passage area of the scroll part 36.

Once the flow passage area A and a sectional shape of the flow passage of the scroll part 36 are defined, it is possible to determine the distance R based on the formula (1). This can, however, be simplified by using, as the distance R, a distance between the axis 50 and the center of the flow passage of the scroll part 36.

Figure 4:
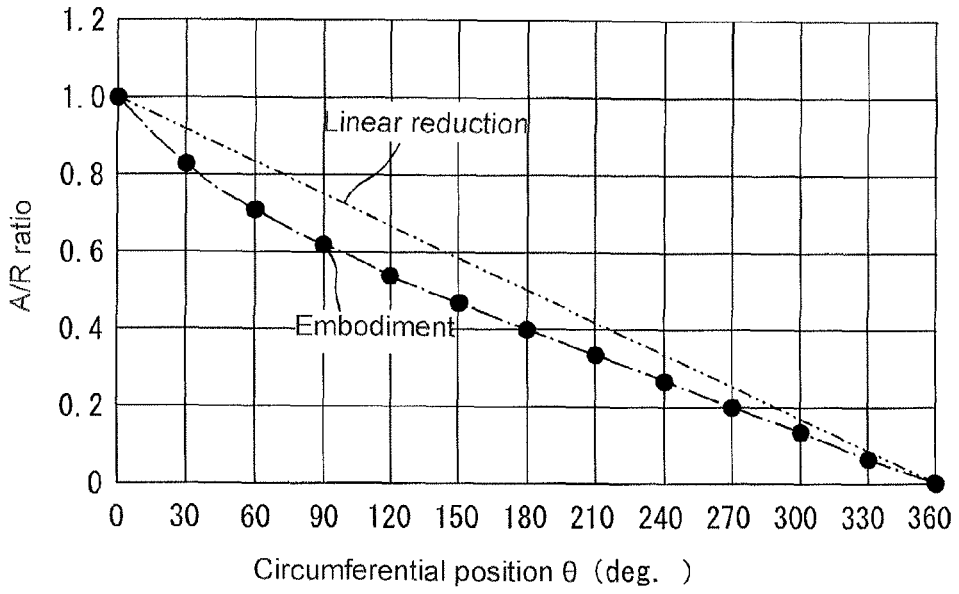
FIG. 4 is a graph where an abscissa represents a circumferential position θ around the axis of the turbine rotor blade and an ordinate represents the A/R ratio, illustrating one embodiment and a linear reduction case as to the relationship between the circumferential position θ and the A/R ratio.

FIG. 4 is a graph where the abscissa represents the circumferential position θ around the axis of the turbine rotor blade 16 and the ordinate represents the A/R ratio, illustrating one embodiment and the linear reduction case, as to the relationship between the circumferential position θ and the A/R ratio. The flow passage area A at the inlet of the scroll part 36 in this embodiment is the same as that in the linear reduction case. The A/R in FIG. 4 is standardized so that the A/R is 1 at the inlet of the scroll part 36.

Figure 5:
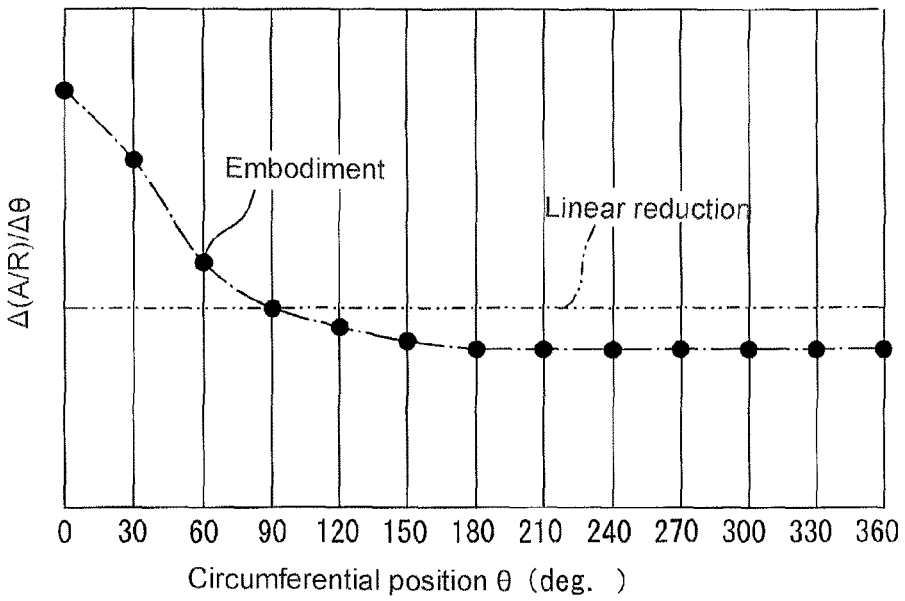
FIG. 5 is a graph where the abscissa represents the circumferential position θ around the axis of the turbine rotor blade and the ordinate represents Δ(A/R)/Δθ which is a ratio of a change rate Δ(A/R) of the A/R ratio to a change rate Δθ of the circumferential position θ, illustrating the embodiment and the linear reduction case, as to the relationship between the circumferential position θ and the ratio Δ(A/R)/Δθ.

FIG. 5 is a graph where the abscissa represents the circumferential position θ around the axis of the turbine rotor blade 16 and the ordinate represents a ratio of a change rate Δ(A/R) of the A/R ratio to a change rate Δθ of the circumferential position θ (hereinafter, referred to as the change rate Δ(A/R)/Δθ as well), illustrating the embodiment and also the linear reduction case, as to the relationship between the circumferential position θ and the change rate Δ(A/R)/Δθ. The curve of FIG. 5 represents absolute values of differentiated A/R curve of FIG. 4.

Figure 6:
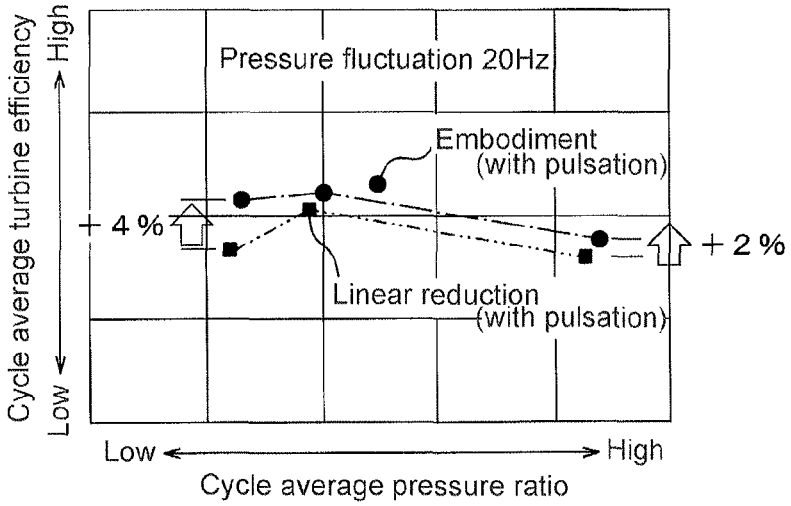
FIG. 6 is a graph where the abscissa represents a cycle average turbine pressure ratio and the ordinate represents a cycle average turbine efficiency, illustrating the embodiment and the linear reduction case, as to a relationship between the cycle average turbine pressure ratio and the cycle average turbine efficiency when the pressure fluctuation of exhaust gas is 20 Hz.

FIG. 6 is a graph where the abscissa represents a cycle average turbine pressure ratio and the ordinate represents a cycle average turbine efficiency, illustrating the embodiment and the linear reduction case, as to the relationship between the cycle average turbine pressure ratio and the cycle average turbine efficiency when the pressure fluctuation of exhaust gas is 20 Hz.

The cycle average turbine pressure ratio is an average value of the turbine pressure ratio in one cycle of the pressure fluctuation of the fluid (exhaust gas) introduced to the turbine. The cycle average turbine efficiency is an average value of the turbine efficiency in one cycle of the pressure fluctuation of the exhaust gas.

Figure 7:
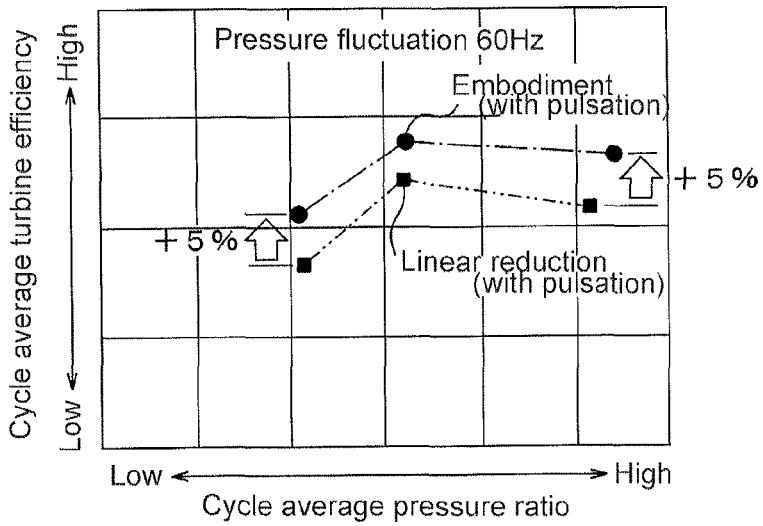
FIG. 7 is a graph where the abscissa represents the cycle average turbine pressure ratio and the ordinate represents the cycle average turbine efficiency, illustrating the embodiment and the linear reduction case, as to a relationship between the cycle average turbine pressure ratio and the cycle average turbine efficiency when the pressure fluctuation of exhaust gas is 60 Hz.

FIG. 7 is, similarly to FIG. 6, a graph where the abscissa represents the cycle average turbine pressure ratio and the ordinate represents the cycle average turbine efficiency, illustrating the embodiment and the linear reduction case, as to a relationship between the cycle average turbine pressure ratio and the cycle average turbine efficiency when the pressure fluctuation of exhaust gas is 60 Hz.

Figure 8:
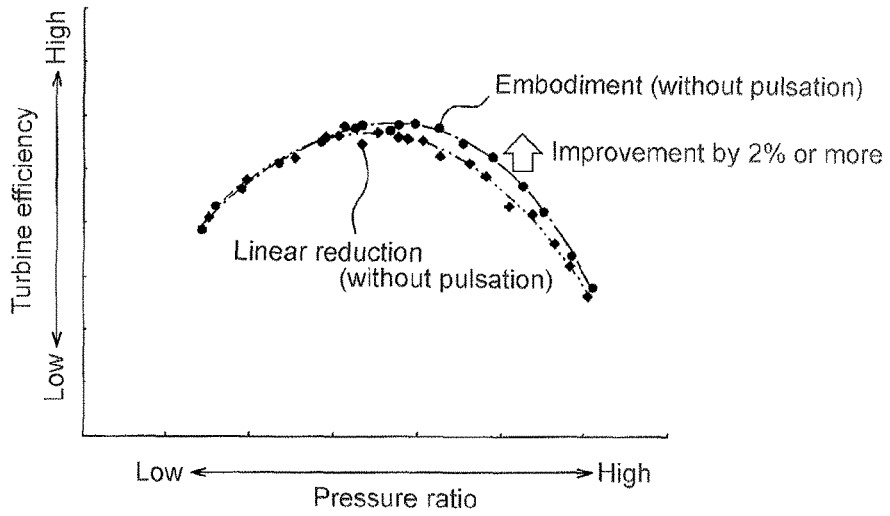
FIG. 8 is a graph where the abscissa represents a turbine pressure ratio and the ordinate represents a turbine efficiency, illustrating the embodiment and the linear reduction case, as to a relationship between the pressure ratio and efficiency when the fluid introduced into the turbine does not contain pulsation.

FIG. 8 is a graph where the abscissa represents a turbine pressure ratio and the ordinate represents a turbine efficiency, illustrating the embodiment and the linear reduction case, as to a relationship between the pressure ratio and the efficiency when the fluid introduced into the turbine does not contain pulsation.

Figure 9:
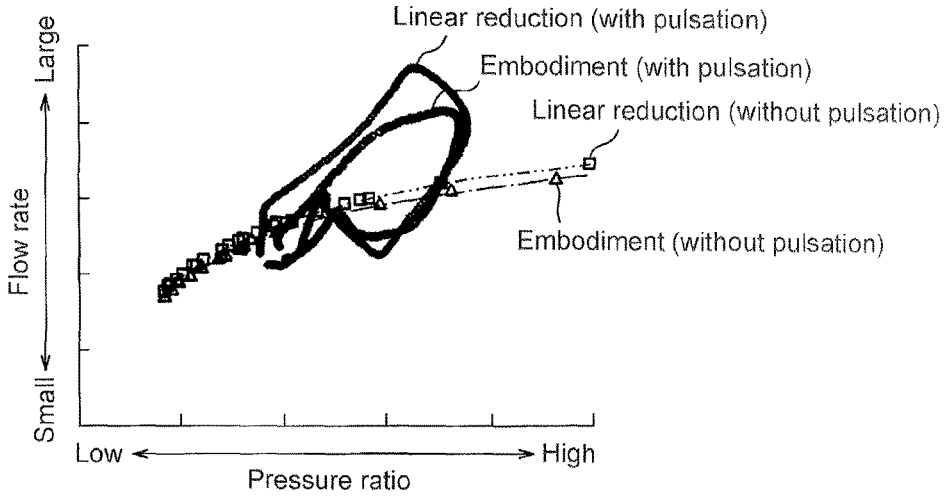
FIG. 9 is a graph where the abscissa represents a turbine pressure ratio and the ordinate represents a turbine flow rate, illustrating the embodiment and the linear reduction case, as to a relationship between the pressure ratio and the flow rate when the fluid introduced into the turbine contains pulsation.

FIG. 9 is a graph where the abscissa represents a turbine pressure ratio and the ordinate represents a turbine flow rate, illustrating the embodiment and the linear reduction case, as to a relationship between the pressure ratio and the flow rate when the fluid introduced into the turbine contains pulsation.

As illustrated in FIG. 4, the scroll part 36 is configured such that the A/R ratio has a concave distribution at least in a part of a graph where the abscissa represents the circumferential position θ around the axis 50 of the turbine rotor blade 16 and the ordinate represents the A/R ratio. In other words, the scroll part 36 the change rate Δ(A/R)/Δθ on the inlet side is larger than the change rate Δ(A/R)/Δθ on the end side. The larger change rate Δ(A/R)/Δθ means a larger absolute value.

With this configuration, the A/R has a concave distribution at least in a part of the graph as illustrated in FIG. 4, and the flow passage area A of the scroll part 36 changes more significantly on the inlet side than on the end side. Therefore, the volume of the scroll part 36 is significantly reduced on the inlet side compared to the conventional case.

With the reduced volume of the scroll part 36 on the inlet side, the amplitude of the pulsation pressure of the fluid is increased on the inlet side of the scroll part 36. Further, with the increased pulsation pressure on the inlet side, the fluid flows smoothly on the inlet side of the scroll part 36 toward the turbine rotor blade 16. As a result, the turbine efficiency is improved, hence improving the turbine output.

Specifically, as illustrated in FIG. 6, even in the case where the fluid to be introduced contains low frequency pulsation, the cycle average turbine efficiency is improved in the embodiment, compared to the linear reduction case where the A/R decreases linearly, by 4% on a low side where the cycle average pressure ratio is low and by 2% on a high side where the cycle average pressure ratio is high.

As illustrated in FIG. 7, even in the case where the fluid to be introduced contains relatively high frequency pulsation, the cycle average turbine efficiency is improved in the embodiment, compared to the linear reduction case, by 5% on both the low side and the high side.

Meanwhile, as illustrated in FIG. 8, even in the case the fluid to be introduced does not contain pulsation, the turbine efficiency is improved in the embodiment, compared to the linear reduction case, by 2% or more at maximum on the high side.

In the conventional case where the A/R decreases linearly, it is necessary to reduce the inlet area of the scroll part to reduce the volume of the scroll part. However, if the inlet area of the scroll part is reduced, the flow characteristic changes significantly. In this view, with the above configuration, the volume is made smaller on the inlet side of the scroll part 36 and thus, it is possible to reduce the volume of the scroll part while minimizing the change of the inlet area of the scroll part 36. As a result, with this configuration, it is possible to minimize the effects on the flow characteristic and improve the turbine efficiency.

Specifically, as illustrated in FIG. 9, if the fluid to be introduced does not contain the pulsation, there is no significant difference in the flow characteristic between the embodiment and the case. However, if the fluid contains pulsation, in the linear reduction case, the flow rate changes significantly in response to the change of the pressure ratio, and large hysteresis is observed. In contrast, in the present embodiment, the change of the flow rate in response to the pressure ratio change is suppressed, and the hysteresis is reduced.

In some embodiments, provided that the circumferential position θ is 0° at the inlet of the scroll part 36 and the positional value of the circumferential position θ increases from the inlet toward the end of the scroll part 36, the scroll part 36 is configured such that the change rate Δ(A/R)/Δθ of the A/R while the circumferential position θ changes from 0° to 90° is at least 1.2 times higher than the case where the A/R linearly decreases.

The change rate $\Delta(A/R)/\Delta\theta$ of the A/R while the circumferential position θ changes from 0° to 90° can be obtained such that a difference $((A/R)_{\theta=0}-(A/R)_{\theta=90})$ between the change rate $((A/R)_{\theta=0})$ when the circumferential position is 0° and the change rate $((A/R)_{\theta=90})$ when the circumferential position is 90° is divided by 90° which is the difference of the circumferential position θ.

With this configuration, if the flow passage area A at the inlet of the scroll part 36 is maintained at the same value as the linear reduction case where the A/R decreases linearly, for instance, the volume of the scroll part 36 can be reduced by 5% or more compared to the linear reduction case in the A/R distribution of FIG. 4. As a result, even if there is pulsation, it is possible to reliably improve the turbine efficiency while minimizing the effect on the flow characteristic.

In some embodiments, the scroll part 36 is configured such that the change rate $\Delta(A/R)/\Delta\theta$ of the A/R while the circumferential position θ changes from 0° to 90° is at least 1.4 times higher than the case where the A/R linearly decreases.

With this configuration, if the flow passage area A at the inlet of the scroll part 36 is maintained at the same value as the linear reduction case where the A/R decreases linearly, for instance, in the A/R distribution of FIG. 4, the volume of the scroll part 36 can be reduced by 10% or more compared to the case where the A/R decreases linearly. As a result, it is possible to further improve the turbine efficiency while minimizing the effect on the flow characteristic.

In some embodiments, the scroll part 36 is configured such that the change rate $\Delta(A/R)/\Delta\theta$ of the A/R while the circumferential position θ changes from 0° to 90° is up to three times higher than the case where the A/R linearly decreases.

With this configuration, as the change rate $\Delta(A/R)/\Delta\theta$ of the A/R while the circumferential position θ changes from 0° to 90° is up to three times higher than the linear reduction case, it is possible to prevent local excessive increase of an angle of the flow formed by the scroll part 36, hence suppressing generation of the pressure loss.

In some embodiments, provided that the circumferential position θ is 0° at the inlet of the scroll roll part 36 and the positional value of the circumferential position θ increases from the inlet toward the end of the scroll part 36, the scroll part 36 is configured such that the change rate $\Delta(A/R)/\Delta\theta$ of the A/R of the scroll art 36, in a rage where the circumferential position θ is at least 0° and not greater than 90°, is higher than the case where the A/R linearly decreases.

In some embodiments, the scroll part 36 is configured such that the change rate $\Delta(A/R)/\Delta\theta$ of the A/R of the scroll art 36, in a rage where the circumferential position θ is at least 0° and not greater than 60°, is higher than the case where the A/R linearly decreases. In other words, the scroll part 36 is configured such that, as illustrated in FIG. 4, the inclination of the A/R in the range where the circumferential position θ is at least 0° and not greater than 60° is greater than the case where the A/R linearly decreases.

In some embodiments, the scroll part 36 is configured such that the change rate $\Delta(A/R)/\Delta\theta$ of the A/R of the scroll art 36, at a position where the circumferential position θ is 30°, is 1.3 times higher than the case where the A/R linearly decreases. In other words, the scroll part 36 is configured such that the inclination of the A/R at the 30° position is 1.3 times greater than the case where the A/R linearly decreases.

While the embodiments of the present invention have been described, it is obvious to those skilled in the art that various changes may be made without departing from the scope of the invention, such as modification and arbitrary combination of the embodiments.

DESCRIPTION OF REFERENCE NUMERALS

10 Turbine
12 Compressor
14 Turbine housing
16 Turbine rotor blade
18 Compressor housing
20 Impeller
22 Shaft
24 Turbine casing
26 End wall
28 Bearing housing
30 Compressor casing
32 End wall
34 Tubular part
36 Scroll part
38 Communication part
40 Introducing part
41 Tongue part
42 Outer peripheral wall
44 Wall
48 Circle
50 Axis

The invention claimed is:

1. A turbine comprising:
a turbine rotor blade; and
a turbine casing having,
an introducing part, and
a scroll part extending along a circumferential direction of the turbine rotor blade, an outer peripheral wall of the scroll part extending continuously from an outer peripheral wall of the introducing part,
wherein the outer peripheral wall of the scroll part has a tongue part in contact with a virtual circle around an axis of the turbine rotor blade, and
wherein when a flow passage of an exhaust gas is defined by the outer peripheral wall of the scroll part and the virtual circle, an A/R ratio of a flow passage area A to a distance R between an axis of the turbine rotor blade and a flow passage center of the scroll part has a concave distribution at least in a part of a graph where an abscissa represents a circumferential position around the axis of the turbine rotor blade and an ordinate represents the A/R ratio.

2. The turbine according to claim 1,
wherein, provided that the circumferential position is 0° at an inlet of the scroll part and a positional value of the circumferential position increases from the inlet toward an end of the scroll part, the scroll part is configured such that a rate of change of the A/R while the circumferential position changes from 0° to 90° is at least 1.2 times higher than a case where the A/R linearly decreases.

3. The turbine according to claim 2,
wherein the scroll part is configured such that the rate of change of the A/R while the circumferential position changes from 0° to 90° is at least 1.4 times higher than the case where the A/R linearly decreases.

4. The turbine according to claim 1,
wherein the scroll part is configured such that the rate of change of the A/R while the circumferential position changes from 0° to 90° is up to three times higher than a case where the A/R linearly decreases.

* * * * *